US008662956B2

(12) United States Patent
Seo et al.

(10) Patent No.: US 8,662,956 B2
(45) Date of Patent: Mar. 4, 2014

(54) CONDITIONER OF CHEMICAL MECHANICAL POLISHING APPARATUS

(75) Inventors: Keon Sik Seo, Gyeonggi-do (KR); Jae Phil Boo, Gyeonggi-do (KR); Dong Soo Kim, Gyeonggi-do (KR); Ja Cheul Goo, Gyeonggi-do (KR); Chan Woon Jeon, Gyeonggi-do (KR); Jnn Ho Ban, Gyeonggi-do (KR)

(73) Assignees: Samsung Electronics Co., Ltd., Gyeonggi-do (KR); K.C. Tech Co., Ltd., Gyeonggi-do (KR)

( * ) Notice: Subject to any disclaimer, the term of this patent is extended or adjusted under 35 U.S.C. 154(b) by 286 days.

(21) Appl. No.: 13/099,401

(22) Filed: May 3, 2011

(65) Prior Publication Data

US 2011/0275289 A1 Nov. 10, 2011

(30) Foreign Application Priority Data

May 10, 2010 (KR) ..... 10-2010-0043466

(51) Int. Cl.
*B24B 53/00* (2006.01)
*B24B 1/00* (2006.01)

(52) U.S. Cl.
USPC ..... 451/5; 451/56; 451/21; 451/443

(58) Field of Classification Search
USPC ..... 451/11, 21, 24, 26, 41, 443, 444, 5, 56, 451/9
See application file for complete search history.

(56) References Cited

U.S. PATENT DOCUMENTS

| | | | | |
|---|---|---|---|---|
| 5,325,636 | A * | 7/1994 | Attanasio et al. | 451/24 |
| 5,456,627 | A * | 10/1995 | Jackson et al. | 451/11 |
| 5,569,062 | A * | 10/1996 | Karlsrud | 451/285 |
| 6,123,607 | A * | 9/2000 | Ravkin et al. | 451/56 |
| 6,443,815 | B1 * | 9/2002 | Williams | 451/56 |
| 6,517,414 | B1 * | 2/2003 | Tobin et al. | 451/8 |
| 6,607,426 | B2 * | 8/2003 | Suzuki | 451/56 |
| 6,609,962 | B1 * | 8/2003 | Wakabayashi et al. | 451/443 |
| 6,645,046 | B1 * | 11/2003 | Vogtmann et al. | 451/8 |
| 6,695,680 | B2 * | 2/2004 | Choi et al. | 451/5 |
| 6,896,583 | B2 * | 5/2005 | Rodriquez et al. | 451/5 |
| 6,905,399 | B2 * | 6/2005 | Lischka | 451/72 |
| 6,910,947 | B2 | 6/2005 | Paik | 451/21 |
| 6,945,857 | B1 | 9/2005 | Doan et al. | 451/56 |
| 7,040,956 | B2 | 5/2006 | Paik | 451/5 |
| 7,066,795 | B2 | 6/2006 | Balagani et al. | 451/285 |
| 7,067,432 | B2 | 6/2006 | Xu et al. | 438/710 |

(Continued)

FOREIGN PATENT DOCUMENTS

KR 10-2005-12586 2/2005 ..... H01L 21/304

*Primary Examiner* — Lee D Wilson
*Assistant Examiner* — Tyrone V Hall, Jr.
(74) *Attorney, Agent, or Firm* — Kusner & Jaffe

(57) ABSTRACT

Provided are a conditioner of a chemical mechanical polishing apparatus for polishing a substrate over a platen pad that rotates and a method thereof. The conditioner includes a disk holder, a piston rod, a housing, and a load sensor. The disk holder secures a conditioning disk that finely cuts a surface of the platen pad. The piston rod delivers a normal force to the disk holder. The housing covers at least a portion of the piston rod. The load sensor is installed to receive the normal force that the piston rod delivers to the piston rod and measuring the normal force.

11 Claims, 12 Drawing Sheets

(56) References Cited

U.S. PATENT DOCUMENTS

| | | | | |
|---|---|---|---|---|
| 7,097,535 | B2 * | 8/2006 | Glashauser et al. | 451/5 |
| 7,182,680 | B2 | 2/2007 | Butterfield et al. | 451/443 |
| 7,288,165 | B2 * | 10/2007 | Polyak et al. | 156/345.12 |
| 7,611,400 | B2 * | 11/2009 | Yilmaz et al. | 451/56 |
| 2001/0006874 | A1 * | 7/2001 | Moore | 451/5 |
| 2002/0052166 | A1 * | 5/2002 | Kojima et al. | 451/5 |
| 2002/0055325 | A1 * | 5/2002 | Suzuki | 451/285 |
| 2009/0318060 | A1 * | 12/2009 | Dhandapani et al. | 451/5 |

* cited by examiner

CONDITIONER OF CHEMICAL MECHANICAL POLISHING APPARATUS

CROSS-REFERENCE TO RELATED APPLICATIONS

This U.S. non-provisional patent application claims priority under 35 U.S.C. §119 of Korean Patent Application No. 10-2010-0043466, filed on May 10, 2010, the entire contents of which are hereby incorporated by reference.

BACKGROUND OF THE INVENTION

The present disclosure herein relates to a conditioner of a chemical mechanical polishing apparatus, and more particularly, to a conditioner of a chemical mechanical polishing apparatus, which evenly supplies slurry to a substrate mounted on a carrier head by evenly dispersing slurry over a platen pad of a polishing platen through exact introduction of a predetermined normal force into the platen pad.

Generally, a Chemical Mechanical Polishing (CMP) process is known as a standard process for polishing the surface of a substrate such as a wafer for fabricating a semiconductor including a polishing layer, by counter-rotating the substrate and the polishing platen.

FIG. 1 is a view illustrating a typical chemical mechanical polishing apparatus. As shown in FIG. 1, the chemical mechanical polishing apparatus includes a polishing platen 10 having a platen pad 11 attached thereon, a polishing head 20 mounted with a wafer w to be polished and rotating while contacting the upper surface of the platen pad 11, a conditioner 30 applying a predetermined normal force on the surface of the platen pad 11 to finely cut the surface of the platen pad such that fine pores formed in the surface of the platen pad 11 are exposed.

The polishing platen 10 is attached with the platen pad 11 formed of a polytex material for polishing the wafer w, and rotates due to the rotation of a shaft 12.

The polishing head 20 is disposed over the platen pad 11 of the polishing platen 10, and includes a carrier head 21 gripping the wafer w, and a polishing arm 22 performing a reciprocating motion within a predetermined distance while rotating the carrier head 21.

The conditioner 30 finely cuts the surface of the platen pad 11 such that numerous fine foaming pores serving to contain slurry mixed with abrasives and chemical materials are not blocked, and thus smoothly supplies the slurry filled in the fine foaming pores of the platen pad 11 to the wafer w gripped by the carrier head 21.

For this, the conditioner 30 includes a motor and a gear box therein such that a shaft 33 connected to the holder 32 is rotated, in a state where a holder 32 is gripping a conditioning disk 31 contacting the platen pad 11 during the conditioning process. A cylinder is installed in the housing 34 to apply a downward force 31*p* to the conditioning disk 31 by pneumatic pressure. An arm 35 extending from the housing 34 performs a sweep motion to finely cut the foaming pores over the wide area of the platen pad 11. For the fine cutting of the platen pad 11, the conditioning disk 31 may include diamond particles attached on the surface thereof contacting the platen pad 11. Also, the shaft 33 may be rotated by a driving motor (not shown) installed outside the housing 34.

Thus, in the typical chemical mechanical polishing apparatus, the wafer w to be polished rotates while being attached to the carrier head 21 by vacuum pressure and pressed on the platen pad 11, and at the same time, the platen pad 11 rotates. In this case, slurry supplied from a slurry supplying unit 40 may be supplied to the wafer w that rotates while being fixed on the polishing head 20, in a state where the slurry is contained in numerous foaming pores that is formed in the platen pad 11. Since pressure is continuously applied to the platen pad 11, openings of the foaming pores are gradually clogged to obstruct the slurry from being smoothly supplied into the wafer w.

In order to overcome such a limitation, the conditioner 30 includes a cylinder applying a pressure toward the platen pad 11, rotating the conditioning disk 31 while applying a pressure to the conditioning disk 31 attached with particles such as diamond particles of high hardness. At the same time, the conditioner 30 performs a sweep motion to continuously perform fine cutting on the openings of the foaming pores that are distributed over the whole area of the platen pad 11. Thus, slurry contained in the foaming pores over the platen pad 11 can be smoothly supplied to the wafer w.

In this case, if the conditioning disk 31 of the conditioner 30 is not pressurized with an adequate force, the openings of the foaming pores of the platen pad 11 may not be opened to obstruct slurry from being smoothly supplied to the wafer w. If the conditioning disk 31 is pressurized with an excessive force, the openings of the platen pad 11 may be opened but the lifespan of the platen pad 11 may be shortened to reduce the economic efficiency.

Although the vertical force of the conditioning disk 31 is controlled by the cylinder such that a predetermined force is applied, the normal force that is substantially applied on the surface of the platen pad 11 may be lost at an intermediate path, for example, a joint of the conditioner 30 that transmits the normal force, or a desired normal force may not be transmitted due to an error of the normal force that may be caused by a cylinder used for a long time. Accordingly, there is a limitation in that slurry contained in numerous foaming pores of the platen pad 11 is not smoothly delivered to the wafer.

SUMMARY OF THE INVENTION

The present disclosure provides a conditioner of a chemical mechanical polishing apparatus, which evenly supplies slurry to a substrate mounted on a carrier head by evenly dispersing slurry on a platen pad of a polishing platen through exact introduction of a predetermined normal force into the platen pad.

The present disclosure also provides a conditioner of a chemical mechanical polishing apparatus, which secures enough lifespan of a platen pad and smoothly supplies slurry to a substrate such as a wafer through uniform fine cutting over the platen pad using a conditioner, by detecting that a relatively large normal force is applied to a specific side of a conditioning disk during the rotation thereof, and allowing the normal force to be uniformly applied to the whole of the conditioning disk.

Embodiments of the inventive concept provide conditioners of chemical mechanical polishing apparatuses for polishing a substrate over a platen pad that rotates, the conditioner including: a disk holder securing a conditioning disk that finely cuts a surface of the platen pad; a piston rod delivering a normal force to the disk holder; a housing covering at least a portion of the piston rod; and a load sensor installed to receive the normal force that the piston rod delivers and measuring the normal force.

In some embodiments, the piston rod may be located on the same axis as a center of rotation of the conditioning disk.

In other embodiments, the load sensor may be interposed between the piston rod and the disk holder.

In still other embodiments, the conditioner may further include: a shaft upwardly spaced from the piston rod; a cylinder surrounding the shaft and the piston rod such that a pneumatic pressure chamber is formed between the shaft and the piston rod, rotating together with the shaft and the piston rod, and having a step at an outer circumferential surface thereof, the step delivering a force to the load sensor in an upper direction. Here, the load sensor may be installed to be supported by the housing, and a reaction force of the normal force delivered to the cylinder through the step of the cylinder may be delivered to the load sensor.

In even other embodiments, the load sensor may be disposed at a side of an outer circumference of the cylinder, and a bearing may be installed therebetween to allow a relative rotational displacement.

In yet other embodiments, delivering of the normal force to the load sensor by the step may include delivering a shearing force via the bearing.

In further embodiments, the load sensor may measure the normal force from a strain caused by receiving the normal force.

In still further embodiments, the load sensor may include a load cell.

In even further embodiments, the load sensor may include a strain gauge having an electric resistance varying according to the strain to measure the normal force using the strain gauge.

In yet further embodiments, the conditioner may further include a controller for controlling the normal force applied by the piston rod to reach a predetermined value if there is a difference between a value of the normal force measured by the load sensor and the predetermined value.

In much further embodiments, the load sensor may be divided into two or more segments such that the segments measure normal forces around the piston rod, respectively.

In still much further embodiments, the piston rod may be formed into a plurality of segments, and if there is a deviation among the normal forces measured by the segments of the load sensor, the conditioner may further include a controller for controlling the deviation of the normal forces to become smaller than a predetermined value.

In other embodiments of the inventive concept, conditioning methods of a chemical mechanical polishing process for fining cutting an upper surface of a platen pad using a plurality of pores containing slurry include: rotating a platen pad while contacting a substrate to be polished; rotating a conditioning disk having particles having a hardness enough to finely cut the platen pad while apply a downward pressure to the conditioning disk through a piston rod; and measuring a normal force that is applied to the conditioning disk through the piston rod.

In some embodiments, the measuring of the normal force may include measuring the normal force using a load value sensed by a load sensor when a pressurizing part of the piston rod located on the same axis as a center of rotation of the conditioning disk applies a pressure to the load sensor fixed at a housing that covers at least a portion of the piston rod.

In other embodiments, the measuring of the normal force may include measuring the normal force by measuring a reaction force delivered to the load sensor when the piston rod located on the same axis as a center of rotation of the conditioning disk applies a pressure to a disk holder to allow the reaction force facing upward and generated by a normal force that contacts the conditioning disk with the platen pad to be delivered to a cylinder surrounding the piston rod and then delivered to the load sensor located around an outer circumference of the cylinder by a step formed on an outer circumferential surface of the cylinder.

In still other embodiments, the method may further include adjusting a magnitude of the normal force delivered through the piston rod when there is a difference between a value of the normal force measured in the measuring of the normal force and a predetermined value.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE INVENTION

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art.

Hereinafter, a chemical mechanical polishing apparatus according to an embodiment of the inventive concept will be described in detail with reference to the accompanying drawings. For explanation of the inventive concept, however, a detailed description of known functions or configurations will be omitted to clarify the point of the inventive concept.

Figure 1:
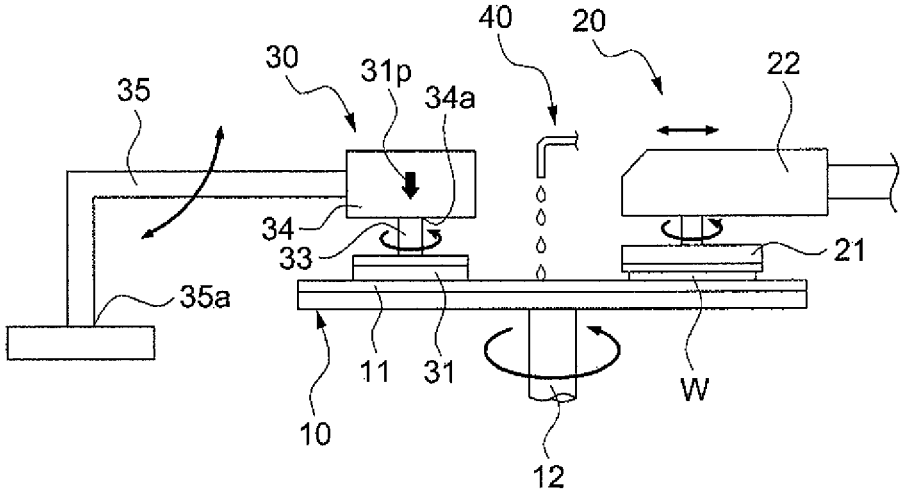
FIG. 1 is a view illustrating a configuration of a typical chemical mechanical polishing apparatus.
Figure 2:
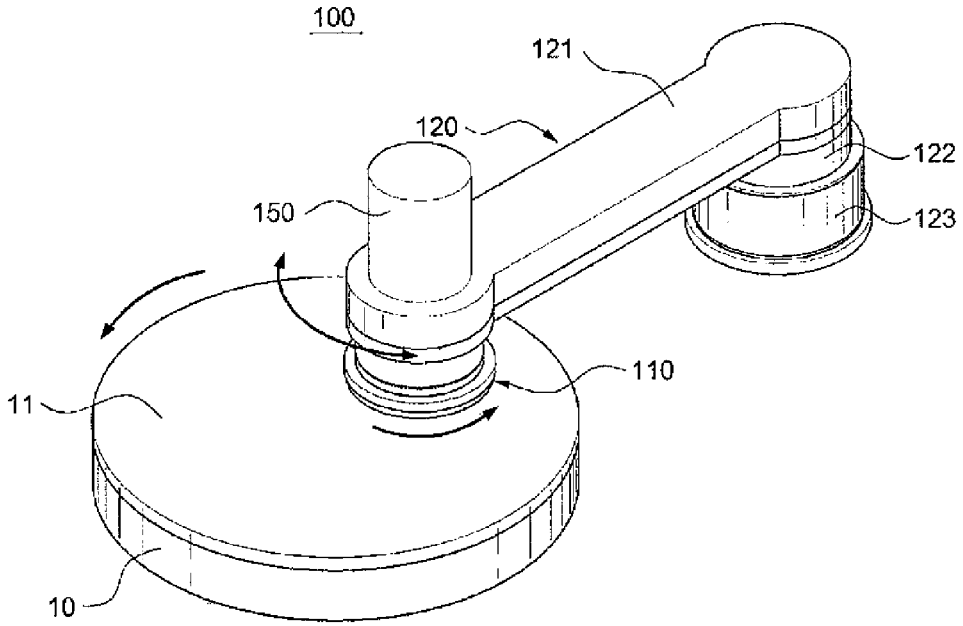
FIG. 2 is a perspective view illustrating a configuration of a conditioner of a chemical mechanical polishing apparatus according to an embodiment of the inventive concept.
Figure 3A:
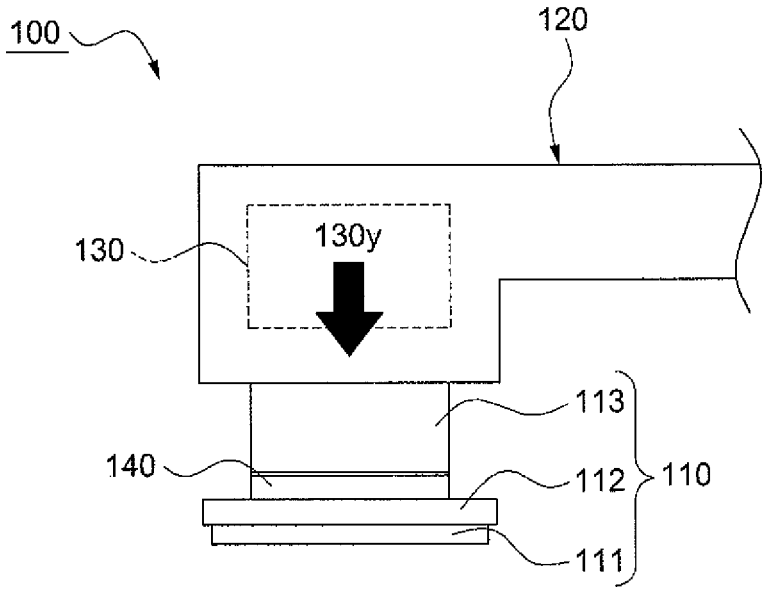
FIGS. 3A and 3B are schematic views illustrating an introduction of a normal force of the conditioner of FIG. 2.

As shown in FIG. 3A, a conditioner 100 of a chemical mechanical polishing apparatus according to an embodiment of the inventive concept may include a disk holder 112, an actuator 130, a piston rod 113, a housing 120, a load sensor 140, a motor 150, and a controller (not shown). The disk holder 112 may grip a conditioning disk 111 that finely cuts the surface of a platen pad 11 by rotating while contacting the surface of the platen pad 11 on a polishing plate 10. The actuator 130 may generate a downward normal force 130*y* by pneumatic force. The piston rod 113 may deliver the normal force 130*y* generated from the actuator 130 to the disk holder 112. The housing 120 may cover at least a portion of the piston rod 113. The load sensor 140 may be installed to receive the normal force 130*y* that is introduced to the disk holder 112 by the piston rod 113, and measure the normal force 130*y*. The motor 150 may rotate the piston rod 113 and the disk holder 112. The controller may correct the normal force generated in the actuator 130 based on the normal force 130*y* that is measured by the load sensor 140.

In the conditioner 100 configured as above, the normal force 130*y* generated in the actuator 130 may be directly delivered to the conditioning disk 111 through the disk holder 112, and may be directly measured by the load sensor 140. Accordingly, although the normal force 130*y* generated in the actuator 130 is different from a predetermined value, and slight gaps exist at joints between housing members 122, 122, and 123 because the conditioner 100 is formed to have an arm shape, the normal force applied to the platen pad 11 by the conditioning disk 111 may be uniformly maintained by the controller for controlling the normal force 130*y* generated in the actuator 130 to be a predetermined value.

Figure 3B:
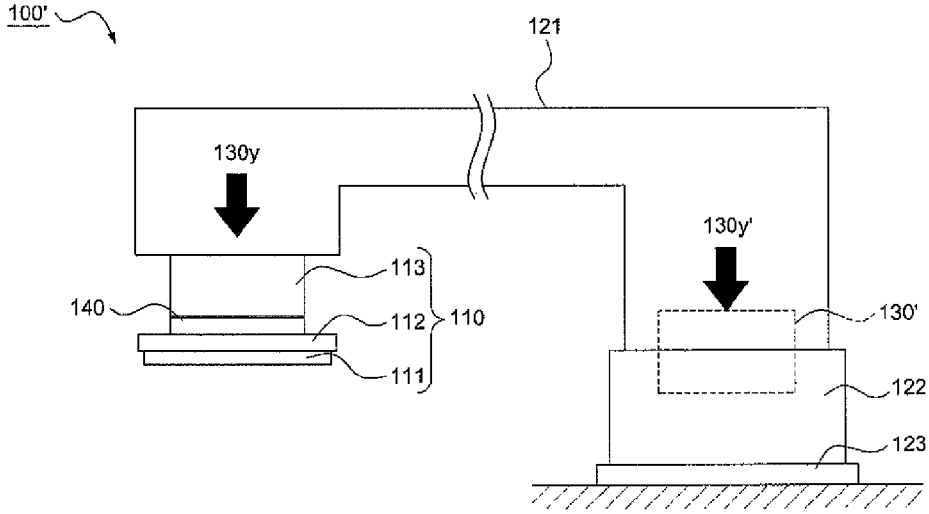

On the other hand, as shown in FIG. 3B, a conditioner 100' according to another embodiment of the inventive concept may have a difference from the conditioner 100 described above in that an actuator 130' is not located over the conditioning disk 111 but on the pivot of the conditioner 100'. In this case, a normal force 130*y*' generated in the actuator 130' located on the pivot may be delivered to a piston rod 113 located on the same axis as the conditioning disk 111 by various link mechanisms.

In the conditioner 100' configured as above, the normal force 130*y*' generated by the actuator 130' may be delivered to the piston rod 113 on the same axis as the conditioning disk 111. The normal force 130*y*' generated in the actuator 130 may have the same direction as the normal force 130*y* introduced to the conditioning disk 111. However, an incalculable portion of the normal force 130*y*' may be lost at joints of a housing 120 during delivery of the normal force 130*y*' applied on the pivot to the conditioning disk 111.

However, in the conditioner 100' of the inventive concept, a load sensor 140 may be located in the piston rod 113 that delivers the normal force 130*y*. The load sensor 140 may directly measure the normal force 130*y* introduced into the disk holder 112. A controller (not shown) may control the normal force 130*y*' generated in the actuator 130' located on the pivot, based on the above measured value. Accordingly, the normal force 130*y* having a predetermined magnitude may be constantly delivered to the disk holder 112.

Figure 9:
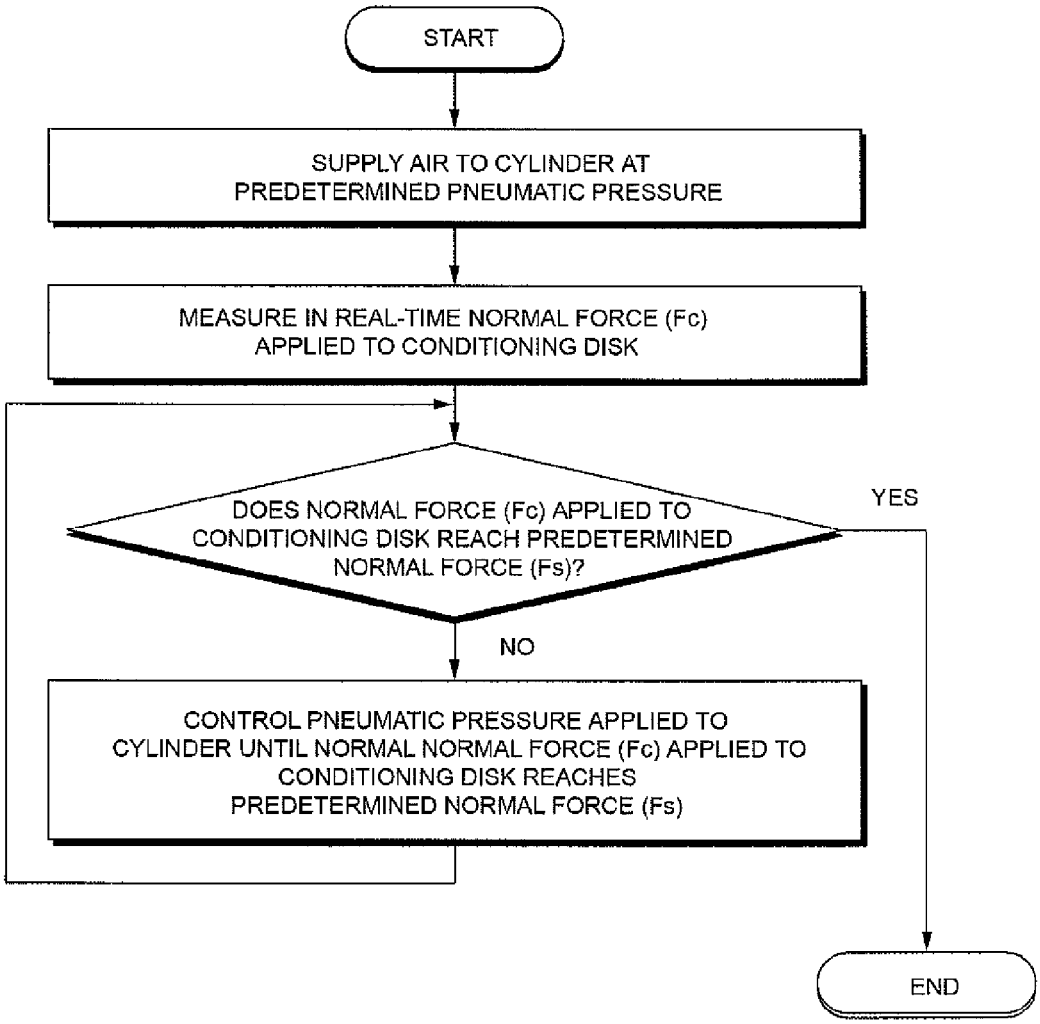
FIG. 9 is a flowchart illustrating a method of operating a conditioner of a chemical mechanical polishing apparatus according to an embodiment of the inventive concept.

Thus, in the conditioners 100 and 100' according to the embodiments, the normal force 130*y* introduced to the conditioning disk 111 may be directly measured. As shown in FIG. 9, the normal force having a predetermined magnitude may be applied to the platen pad 11 based on the normal force Fc. Accordingly, the normal force that the conditioning disk 111 applies to the platen pad 11 may be constantly maintained at a certain value. Slurry in the foaming pores of the platen pad 11 may be evenly dispersed through the opening having an appropriate size. Since the slurry can be uniformly supplied to a substrate w mounted on a carrier head 20, the chemical polishing process can be smoothly performed.

Figure 4A:
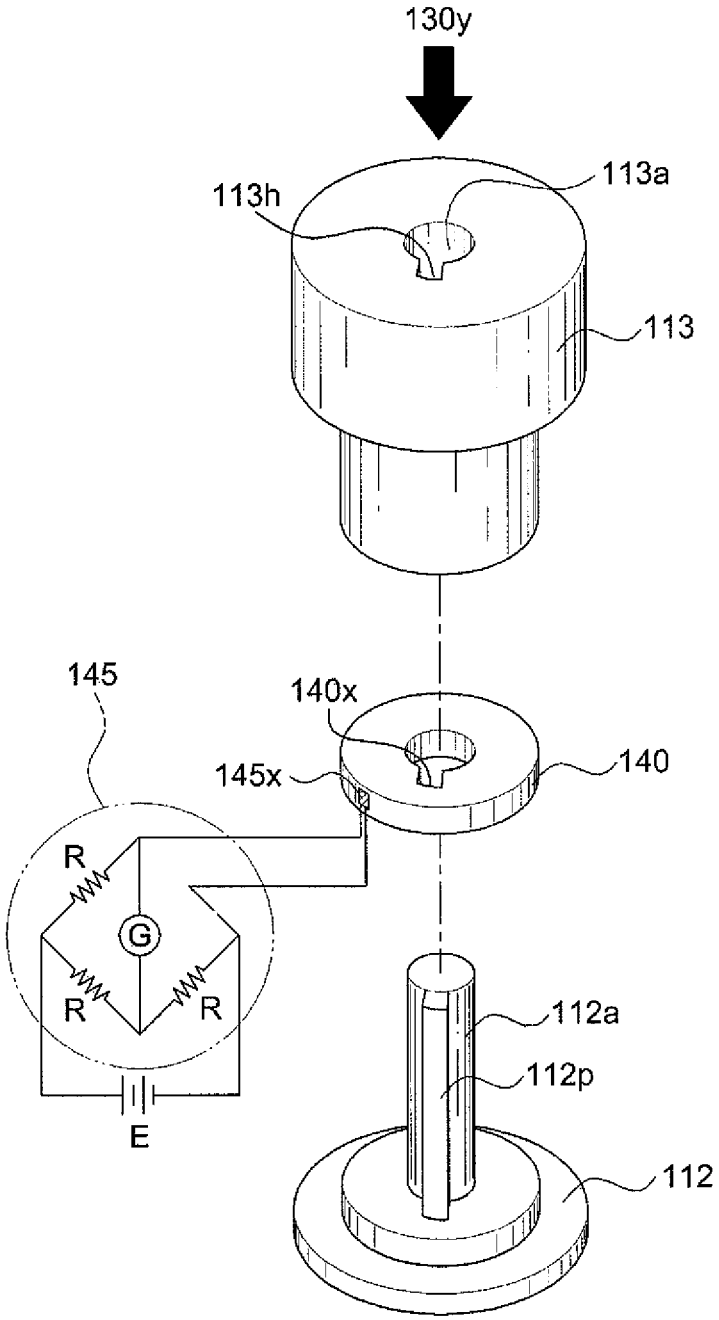
FIGS. 4A and 4B are exploded perspective views illustrating a configuration for measuring a normal force introduced into a conditioning disk.
Figure 4B:
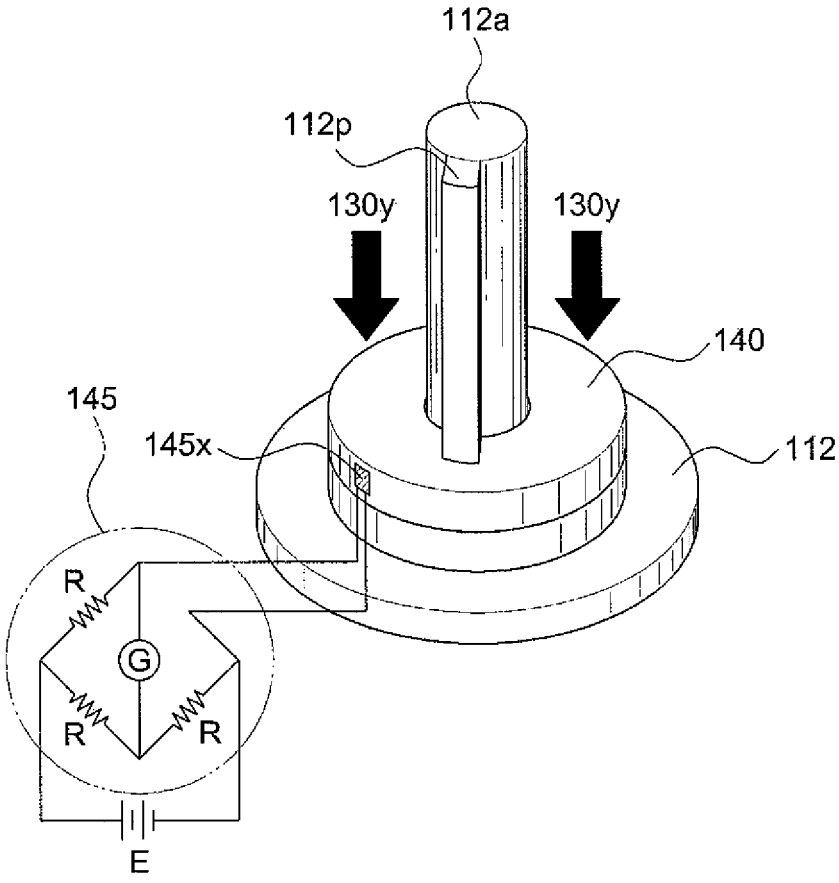

FIGS. 4A and 4B illustrates the load sensor 140 disposed between the piston rod 113 and the disk holder 112, which directly measures the normal force 130*y*. The load sensor 140 may include a load cell. However, a strain gauge 145*x* may detect a strain according to the compression displacement and the bending displacement (although a compression displacement has been illustrated in the drawing, the load sensor may be configured to have a shape or disposition such that a bending displacement is caused) with a strain gauge 145*x*, and may measure the normal force 130*y* introduced to the disk holder 112 from the strain. In this case, the strain gauge 145*x* may include a Wheatstone bridge having a quarter-bridge form as shown in FIG. 4A to measure the normal force 130*y*, or may include a half-bridge or a full-bridge to increase the measurement sensitivity and compensate for a deviation in accordance with direction.

Since the piston rod 113 shown in FIGS. 4A and 4B rotates together with the disk holder 112, a protrusion 112*p* receiving a torque may be formed on a shaft 112*a*, and a hole 113*a* and grooves 140*x* and 113*h* through which the shaft 112*a* and the protrusion 1120 penetrate may be formed. That is, since the load sensor 140 rotates together with the disk holder 112 and the piston rod 113, a signal line (although not shown) from the load sensor 140 may be connected to an external signal processing device through a slip ring.

Figure 5:
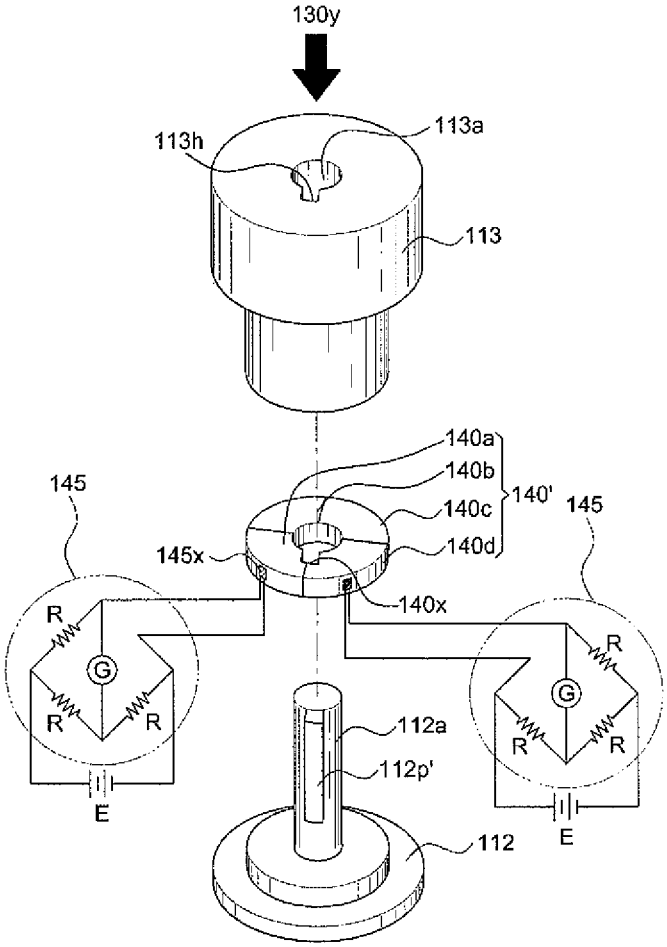
FIG. 5 is an exploded perspective view illustrating a configuration for measuring a normal force of a chemical mechanical polishing apparatus according to another embodiment of the inventive concept.

As shown in FIG. 5, the load sensor 140 may be divided into a plurality of segments 140*a*, 140*b*, 140*c* and 140*d* according to the rotation angle of the shaft to measure the normal forces at each rotation angle. For this, the load sensor 140 may be installed so as not to rotate together with the disk sensor 140 and the piston rod 113.

That is, a protrusion 112*p*' formed on the shaft 112*a* of the disk holder 112 may protrude only at a position spaced from the bottom so as to counter-rotate with respect to the load sensor 140 when the load sensor 140 is installed. Although not shown, thrust bearings may be installed on the upper surface and the undersurface of the load sensor 140 to allow a relative rotational displacement while receiving an axial force. Also, although not shown, each outer circumferential surface of the load sensor 140 may be fixed on a housing 120 to restrain an absolute rotational displacement.

Accordingly, each of segments 140*a*, 140*b*, 140*c* and 140*d* of the load sensor 140 may measure a component of the normal force 130*y* applied to the disk holder 112 in a state where the segments 140*a*, 140*b*, 140*c* and 140*d* do not rotate, according to the rotation angle. Thus, the load sensor 140 may detect an eccentric load that is significantly imposed on one side during the rotation of the conditioning disk 111. When an eccentric load imposed on one side is detected, if the piston rod 113 is divided into segments, the deviation of normal forces applied to each segment of piston rod 113 may be controlled to allow the normal force 130*y* applied by the conditioning disk 111 to be uniformly distributed over the entire area.

Figure 6A:
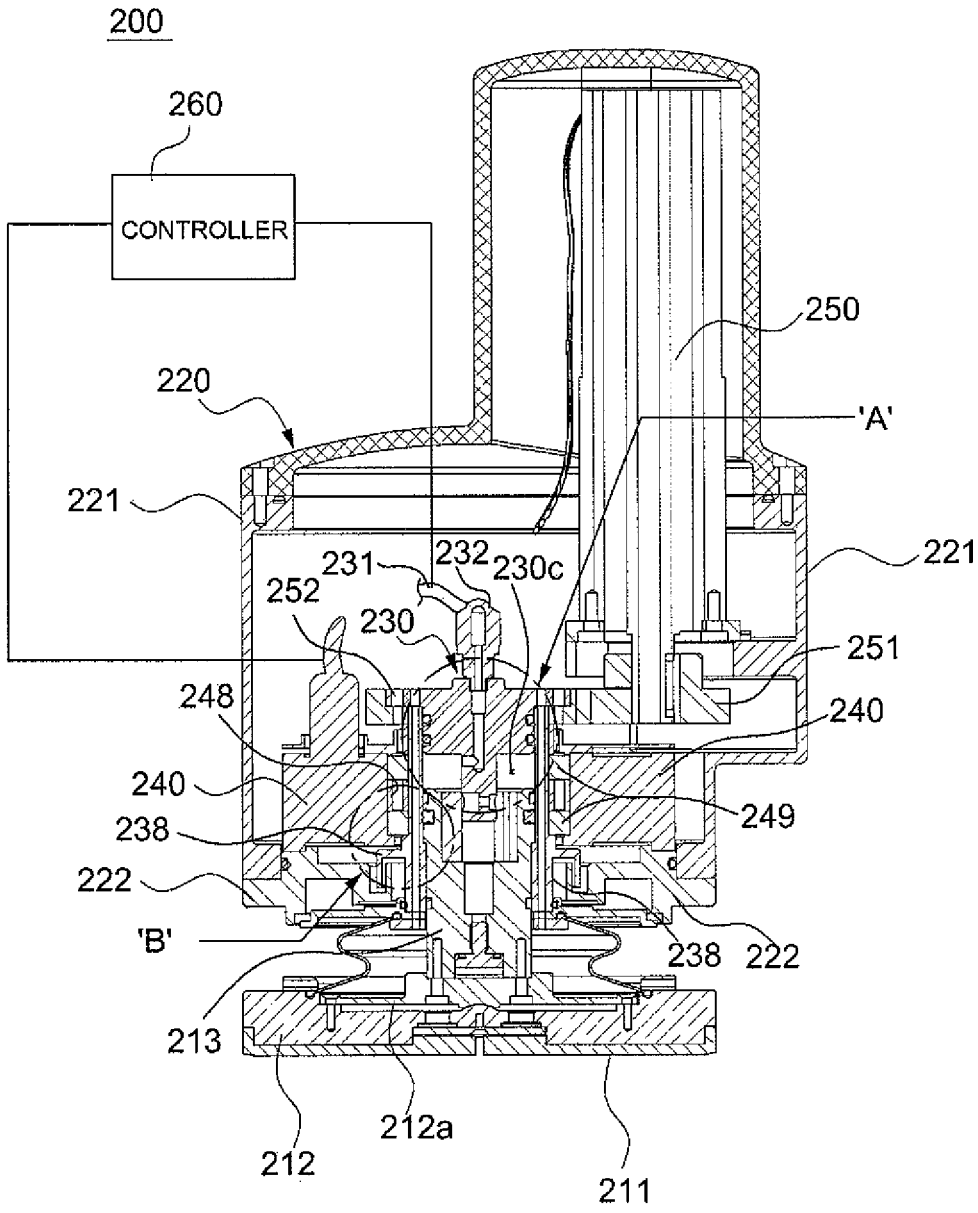
FIGS. 6A and 6B are cross-sectional views illustrating a configuration of a conditioner of a chemical mechanical polishing apparatus according to still another embodiment of the inventive concept.
Figure 6B:
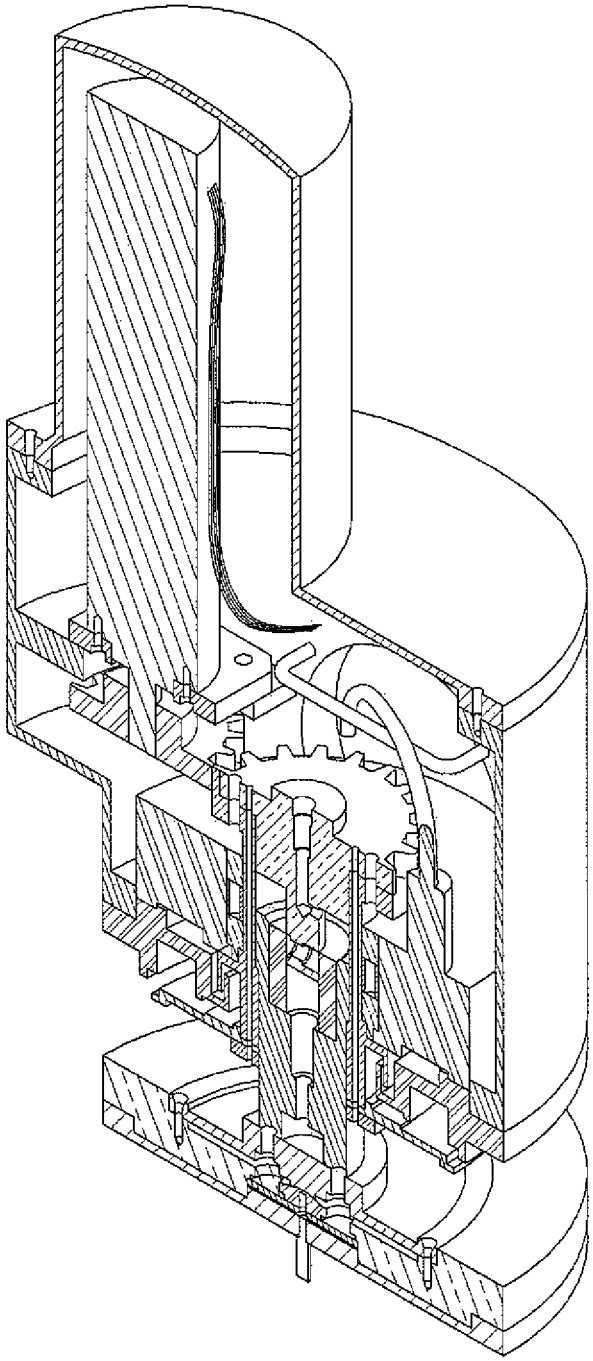

FIGS. 6A through 8 illustrate a configuration of a conditioner 200 according to still another embodiment of the inventive concept. As shown in FIG. 6A, the conditioner 200 may include a disk holder 212, an actuator 230, a piston rod 213, a housing 220, a housing 220, a load sensor 240, a motor 250, and a controller 260. The disk holder 212 may grip a conditioning disk 211 that finely cuts the surface of a platen pad 11. The actuator 230 may generate a downward normal force 130*y* by pneumatic force. The piston rod 213 may deliver the normal force 130*y* generated from the actuator 230 to the disk holder 212. The housing 220 may cover at least a portion of the piston rod 213. The load sensor 240 may measure a reaction force having the same magnitude as the normal force 130*y*, by allowing the piston rod 213 to apply the disk holder 212 to the platen pad 11. The motor 250 may rotate the piston rod 213 and the disk holder 212. The controller 260 may correct the normal force generated in the actuator 230 based on the normal force 130*y* that is measured by the load sensor 240.

A pinion 251 that is rotated by the driving motor 250 may engage with a gear 252 fixed on the outer circumference of the shaft 232. Thus, the shaft 232 may be rotated by the driving motor 250.

Figure 7:
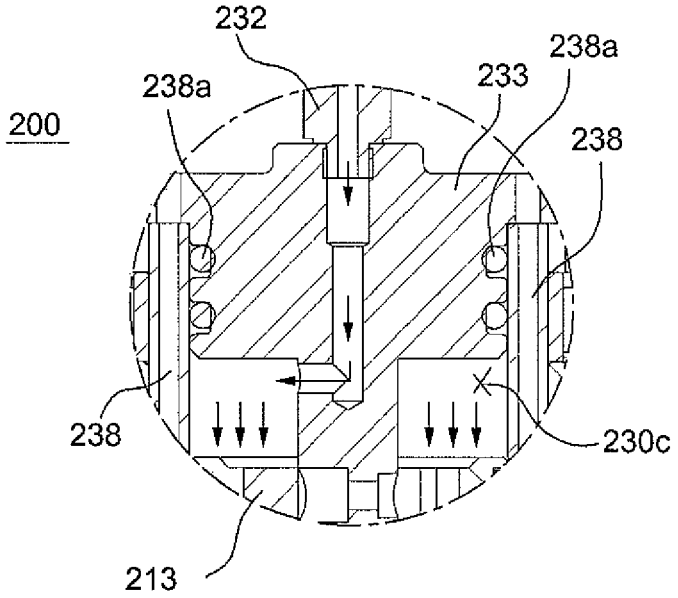
FIG. 7 is a magnified view of a circle A of FIG. 6A.

As shown in FIG. 7, the actuator 230 may include a shaft 232 surrounded by a cylinder 238 and a chamber 230*c* formed in the piston rod 213. In this case, the actuator 230 may allow high-pressure air may to flow into the chamber 230*c* through a pneumatic pressure supply tube 231 and thus maintain the internal pressure of the chamber 230*c*. Thus, the piston rod 213 may be downwardly moved with a normal force having a predetermined magnitude. For this, a tube 231 may be connected to the central portion of the shaft with a rotary fitting 231. High-pressure air may be supplied into the chamber 230*c* through the tube 231.

The normal force of the piston rod 213 that applies a pressure in a downward direction may be delivered to the disk holder 212 through a medium member 212*a*. The conditioning disk 211 gripped by the disk holder 212 may serve to apply a pressure on the platen pad 11.

The shaft 232 of the conditioner 200 may be rotated by the pinion 251 of the driving motor 250. The cylinder 238 airtightly coupled to the shaft 232 using a sealing ring 238*a* may rotate together with the shaft 232.

If the disk holder 212 applied with a pressure while being rotated by the driving motor 250 moves downward to contact the conditioning disk 211 with the platen pad 11, the normal force applied to the disk holder 212 may act as a reaction force that faces upward. In this case, if the platen pad 11 is approximated to a rigid body, the reaction force may act with the same magnitude as the normal force applied to the disk holder 212.

Figure 8:
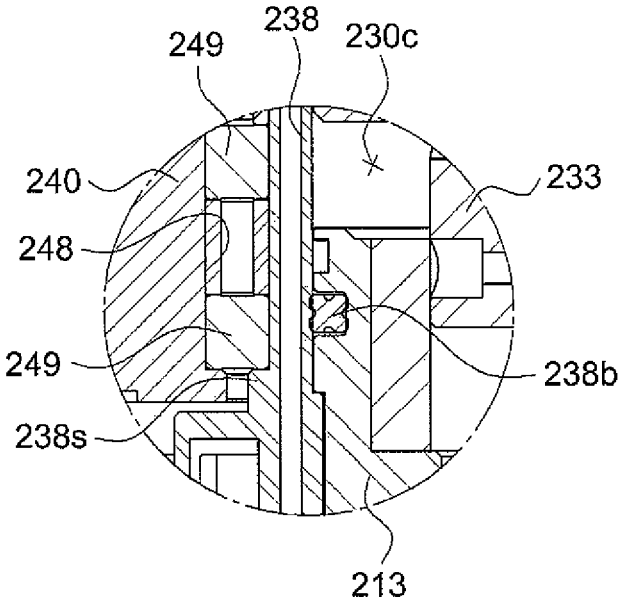
FIG. 8 is a magnified view of a circle B of FIG. 6A.

Due to the reaction force caused by the normal force that pushes the conditioning disk 211 downwardly, an upward displacement may be generated at the cylinder 238, the piston rod 213, and the shaft 232 that rotate. In this case, a step 238*s* may be formed on the outer wall of the cylinder 238 as shown in FIG. 8. While the cylinder 238 is being lifted upward, the inner race of a bearing 249 may be together lifted upward by the step 238*s*.

Here, the load sensor 240 disposed to surround the cylinder 238 may be fixed while being supported by a housing 221. That is, since the load sensor 240 stands still without rotating, a signal line from the load sensor 240 may be connected to an external signal processing device without a slip ring. Since the cylinder 238 rotates due to driving of the motor 250, and the load sensor 240 stands still without rotating, a bearing 249 including a pair of ball bearings or roller bearings vertically spaced from each other by a spacer 248 may be disposed between the load sensor 240 and the cylinder 238.

The inner race of the bearing 248 may be located over the step 238*s* of the cylinder 238 to move upward together according to upward lifting of the cylinder 238. Also, the outer race of the bearing 249 may be fixed on the inner circumferential surface of the load sensor 240 by a press fit, delivering an upward displacement of the cylinder 238 to the inner race of the bearing 249 by a ball or roller of the bearing 249.

That is, the upward reaction force generated by the normal force that is applied to the disk holder 212 by the piston rod 213 may cause the upward movement of the cylinder 238. A pair of bearings 249 may move upward according to the upward movement of the cylinder 238, and a displacement thereof may be delivered to the outer race of the bearing 249 by the ball or roller of the bearing 249. Subsequently, the normal force applied to the conditioning disk 111 through the piston rod 213 may act as a shearing force on the inner circumferential surface of the load sensor 240. Accordingly, the reaction force may be measured from a shear strain acting on the inner circumferential surface of the load sensor 240 by a strain gauge or a load cell.

As shown in FIG. 9, based on a normal force (reaction force) Fc, the amount of a high-pressure air supplied to a chamber 230*c* may be controlled such that normal force Fs having a predetermined magnitude is applied to a platen pad 11. Thus, the normal force that conditioning disk 111 applies to the platen pad 111 may be maintained at a constant value. Accordingly, since slurry introduced into foaming pores of the platen pad 11 is evenly dispersed through an opening having an appropriate size, and thus the slurry is uniformly supplied to a substrate w mounted on a carrier head 20, a smooth chemical polishing process can be ensured.

By measuring the normal force applied to the conditioning disk 111 from the reaction force, a signal from a load sensor 240 can be stably received without a slip ring while moving a cylinder 238 of an actuator 230 close to a disk holder 212.

As described above, the inventive concept provides a conditioner of a chemical mechanical polishing apparatus for polishing a substrate over a platen pad that rotates and a method thereof, including: a disk holder securing a conditioning disk that finely cuts a surface of the platen pad; a piston rod delivering a normal force to the disk holder; a housing covering at least a portion of the piston rod; and a load sensor installed to receive the normal force that the piston rod delivers to the piston rod and measuring the normal force. According to embodiments of the inventive concept, the platen pad can be finely cut evenly over the whole surface thereof by the conditioner to secure enough lifespan of the platen pad and smoothly supply slurry to the substrate such as a wafer, by maintaining the normal force introduced to the conditioning disk at a predetermined constant value.

Accordingly, the inventive concept has an advantage effect of evenly supplying slurry to a substrate mounted on a carrier head by exactly introducing a predetermined normal force over the plate pad and evenly dispersing slurry to be coated on the platen pad of a polishing platen.

Also, the inventive concept can secure enough lifespan of the platen pad and smoothly supply slurry to the substrate such as a wafer through uniform fine cutting over the platen pad using a conditioner, by detecting that a relatively large normal force is applied to a specific side of a conditioning disk during the rotation thereof, and allowing the normal force to be uniformly applied to the whole of the conditioning disk.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

Having described the invention, the following is claimed:

1. A conditioner of a chemical mechanical polishing apparatus for polishing a substrate over a platen pad that rotates, the conditioner comprising:

a disk holder securing a conditioning disk that finely cuts a surface of the platen pad;

a piston rod delivering a normal force to the disk holder;

a housing covering at least a portion of the piston rod;

a load sensor installed to receive the normal force that the piston rod delivers and measuring the normal force;

a shaft upwardly spaced from the piston rod; and a cylinder surrounding the shaft and the piston rod such that a pneumatic pressure chamber is formed between the shaft and the piston rod, rotating together with the shaft and the piston rod, and having a step at an outer circumferential surface thereof, the step delivering a force to the load sensor in an upper direction, wherein the load sensor is installed to be supported by the housing, and a reaction force of the normal force delivered to the cylinder through the step of the cylinder is delivered to the load sensor.

2. The conditioner of claim 1, wherein the piston rod is located on the same axis as a center of rotation of the conditioning disk.

3. The conditioner of claim 2, wherein the load sensor is interposed between the piston rod and the disk holder.

4. The conditioner of claim 1, wherein the load sensor is disposed at a side of an outer circumference of the cylinder, and a bearing is installed therebetween to allow a relative rotational displacement.

5. The conditioner of claim 4, wherein delivering of the normal force to the load sensor by the step comprises delivering a shearing force via the bearing.

6. The conditioner of claim 1, wherein the load sensor measures the normal force from a strain caused by receiving the normal force.

7. The conditioner of claim 6, wherein the load sensor comprises a load cell.

8. The conditioner of claim 6, wherein the load sensor comprises a strain gauge having an electric resistance varying according to the strain to measure the normal force using the strain gauge.

9. The conditioner of claim 6, further comprising a controller for controlling the normal force applied by the piston rod to reach a predetermined value if there is a difference between a value of the normal force measured by the load sensor and the predetermined value.

10. A conditioner of a chemical mechanical polishing apparatus for polishing a substrate over a platen pad that rotates, the conditioner comprising:

a disk holder securing a conditioning disk that finely cuts a surface of the platen pad;

a piston rod delivering a normal force to the disk holder;

a housing covering at least a portion of the piston rod; and a load sensor installed to receive the normal force that the piston rod delivers and measuring the normal force, wherein the load sensor is divided into two or more segments such that the segments measure normal forces around the piston rod, respectively, the two or more segments of the load sensor measure a component of the normal forces in a state where said segments do not rotate.

11. The conditioner of claim 10, wherein the conditioner further comprises:

a controller for controlling the normal forces delivered by the piston rod, the piston rod formed into a plurality of segments, wherein if there is a deviation among the normal forces measured by the segments of the load sensor, the controller controls the deviation of the normal forces to become smaller than a predetermined value.

* * * * *

UNITED STATES PATENT AND TRADEMARK OFFICE

CERTIFICATE OF CORRECTION

PATENT NO. : 8,662,956 B2
APPLICATION NO. : 13/099401
DATED : March 4, 2014
INVENTOR(S) : Seo et al.

It is certified that error appears in the above-identified patent and that said Letters Patent is hereby corrected as shown below:

On the Title Page, Item (75) Inventors, line 5, the inventor identified as "Jnn Ho Ban, Gyeonggi-do (KR)", should read --Jun Ho Ban, Gyeonggi-do (KR)--.

Signed and Sealed this
Thirteenth Day of May, 2014

Michelle K. Lee

Michelle K. Lee
*Deputy Director of the United States Patent and Trademark Office*